US005529635A

United States Patent [19]

Odell

[11] Patent Number: 5,529,635

[45] Date of Patent: Jun. 25, 1996

[54] ULTRASONIC CLEANING OF INTERIOR SURFACES

[75] Inventor: D. MacKenzie C. Odell, Aiken, S.C.

[73] Assignee: The United States of America as represented by the United States Department of Energy, Washington, D.C.

[21] Appl. No.: 275,715

[22] Filed: Jul. 19, 1994

Related U.S. Application Data

[60] Continuation of Ser. No. 77,531, Jun. 17, 1993, abandoned, which is a division of Ser. No. 813,729, Dec. 27, 1991, Pat. No. 5,289,838.

[51] Int. Cl.[6] ..... B08B 3/12

[52] U.S. Cl. ..... 134/1; 134/22.1; 134/22.11

[58] Field of Search ..... 134/1, 22.1, 22.11, 134/169 C

[56] References Cited

U.S. PATENT DOCUMENTS

| | | | |
|---|---|---|---|
| 4,556,467 | 12/1985 | Kuhn et al. | 134/1 X |
| 4,645,542 | 2/1987 | Scharton et al. | 134/1 |
| 4,691,724 | 9/1987 | Garcia et al. | 134/1 X |
| 4,836,684 | 6/1989 | Javorik et al. | 134/1 X |
| 4,966,177 | 10/1990 | John, Jr. et al. | 134/1 X |
| 4,979,994 | 12/1990 | Dussault et al. | 134/1 |
| 5,076,854 | 12/1991 | Honda et al. | 134/1 |
| 5,082,502 | 1/1992 | Lee et al. | 134/1 |
| 5,137,580 | 8/1992 | Honda | 134/1 |
| 5,339,842 | 8/1994 | Bok | 134/1 |

*Primary Examiner*—David A. Simmons
*Assistant Examiner*—Saeed Chaudhry
*Attorney, Agent, or Firm*—Brian R. Tumm; Harold H. Dixon; William R. Moser

[57] ABSTRACT

An ultrasonic cleaning method for cleaning the interior surfaces of tubes. The method uses an ultrasonic generator and reflector each coupled to opposing ends of the open-ended, fluid-filled tube. Fluid-tight couplings seal the reflector and generator to the tube, preventing leakage of fluid from the interior of the tube. The reflector and generator are operatively connected to actuators, whereby the distance between them can be varied. When the distance is changed, the frequency of the sound waves is simultaneously adjusted to maintain the resonant frequency of the tube so that a standing wave is formed in the tube, the nodes of which are moved axially to cause cavitation along the length of the tube. Cavitation maximizes mechanical disruption and agitation of the fluid, dislodging foreign material from the interior surface.

19 Claims, 2 Drawing Sheets

ULTRASONIC CLEANING OF INTERIOR SURFACES

This is a continuation of application Ser. No. 08/077,531 filed Jun. 17, 1993, abandoned, which is a division of application Ser. No. 07/813,729 filed Dec. 27, 1991, U.S. Pat. No. 5,289,838.

BACKGROUND OF THE INVENTION

1. Field of the Invention

The present invention relates generally to ultrasonic cleaning. In particular, the present invention relates to ultrasonic cleaning of the interior surfaces of elongated tubes. The United States Government has fights in this invention pursuant to Contract No. DE-AC09-89SR18035 between the U.S. Department of Energy and Westinghouse Savannah River Company.

2. Discussion of Background

Pipes or tubes for circulation of process fluids or containment of materials are abundant in industrial facilities. To avoid contamination of chemical compounds used in a process, all pipes, containers, and so forth to be used in the process are thoroughly cleaned before use. In particular, the surfaces of process piping must be cleaned to remove deposits of grease and particulate materials remaining from machining operations.

A number of techniques are available for cleaning elongated tubes. Cleaning is often accomplished simply by submerging the tubes in a cleaning solution for a predetermined time, or by pressure flushing with chlorinated fluorocarbon (CFC) solvents such as methylene chloride toluene. CFC solvents are effective but environmentally undesirable, so their use is being reduced or eliminated in many areas. Aqueous, non-CFC, solvents are biodegradable, thus are considered to be environmentally preferable. However, aqueous solvents are much less effective cleaning agents than CFC solvents when used with these conventional techniques.

High pressure, low-frequency shock waves are used to unplug blocked pipes (Simon, U.S. Pat. No. 4,974,617; Coon et al., U.S. Pat. No. 4,551,041), and clean corrosion products and sedimentation from the interior walls of heat exchanger tubes (Scharton et al., U.S. Pat. No. 4,645,542). Such techniques are, however, not suitable for cleaning the interior surfaces of elongated tubes for the purpose of degreasing, due to the high pressures (up to 5,000 psi) of the shock waves and extended time periods required (1–24 hours).

The use of ultrasonics to enhance the cleaning effectiveness of solvents is well known. Ultrasonic techniques are particularly valuable when aqueous solvents are used, since aqueous solvents are intrinsically less effective than CFC solvents. The object to be cleaned is placed in a bath containing a mixture of water or some other solvent. Ultrasonic waves agitate the mixture, inducing cavitation or fluid breakdown at sites where the localized pressure is low enough that the fluid can no longer support the sound wave. At typical ultrasonic frequencies, cavitation occurs at sound pressures of approximately 0.36 watt/cm$^2$ in water, compared to approximately $1.20\times10^3$ watts/cm$^2$ in air at atmospheric pressure. The mechanical disruption and agitation of the fluid at the cavitation sites significantly enhances its effectiveness as a cleaner and degreaser.

John, Jr. et al. describe an ultrasonic cleaning apparatus for fuel rod tubes in U.S. Pat. No. 4,966,177. These perforated tubes are conveyed through a cleaning bath filled with detergent-containing water. Ultrasonic transducers induce cavitation within the water, thereby cleaning the tubes. This technique is also effective for cleaning the exterior surface of a solid wall tube. However, metals reflect a significant fraction of incident sound energy, so the wall of the tube forms a barrier to efficient energy transfer to the interior. Thus, cavitation cannot readily be induced within the interior of the solid wall of the tube when it is immersed in an ultrasonic bath, so there remains a need for a method for the effective cleaning of the interior surface of a tube.

SUMMARY OF THE INVENTION

According to its major aspects and broadly stated, the present invention is a method and apparatus for cleaning the interiors of tubes. The apparatus comprises a sound reflector and an ultrasonic generator coupled to opposing ends of the tube. Fluid-tight couplings seal the reflector and generator to the tube, preventing leakage of fluid from the interior of the tube. The reflector and generator are operatively connected to actuators, whereby their physical separation and location with respect to the tube can be moved without compromising their respective seals. The frequency of the sound emitted by the generator can be varied. The tube will inherently have one or more resonant frequencies $f_R$, defined by the formula $f_R$=nv/d, where d is the distance between the sound reflector and the sound generator, v the velocity of the sound waves, f the frequency, and n an integer.

The tube is filled with a solvent fluid. The sound generator generates ultrasonic sound waves inside the tube, waves that propagate parallel to the long axis of the tube and are reflected by the sound reflector. The frequency of the sound waves is adjusted until it equals a resonant frequency $f_R$ of the tube, setting up a standing wave within the tube, with fixed regions of low and high sound pressure along the length of the tube. Cavitation occurs at annuli along the tube axis spaced a distance cl/n apart along the inner surface of the tube. Mechanical disruption and agitation of the fluid at those points dislodges foreign material, such grease and particulates (dust, metallic particles from machining operations, and so forth) from the interior surface.

To effectively clean the entire inner surface of the tube, the positions of the standing wave maxima and minima with respect to the tube must be moved. This is accomplished, preferably, by changing the distance between the sound reflector and sound generator, which would change the resonant frequency and the interior points at which cavitation effects are greatest, while varying the frequency of the generated wave so that the standing wave is maintained but the positions of the maxima and minima are moved. For most effective cleaning, the distance is changed several times, so that at the differing resonant frequencies cavitation—and cleaning action—is maximized at essentially every location along the inner surface of the tube.

Optimum cleaning parameters are determined on an empirical basis for each application. For example, where a number of similarly-treated tubes must be cleaned, similar types and quantities of foreign material are expected to be found on the surfaces of all the tubes. The appropriate operating limits, including distance and frequency ranges, duration, and power levels, are determined for one of the tubes, then implemented for each tube in succession.

The cleaning fluid used with this apparatus may be water or some other convenient solvent such as OAKITE NSS, produced by Oakite Products, Inc. OAKITE NSS is a blend of surfactants, inorganic alkaline salts and coupling agents; this blend is silicate-free, biodegradable, non-hazardous and non-ozone depleting and has excellent material compatibility characteristics. In contrast to other ultrasonic cleaning systems, the ultrasonic standing waves produced by the sound generator of the present invention induce cavitation effects in the interior of the tube, significantly enhancing the intrinsic cleaning ability of the fluid. This apparatus is therefore especially suitable for use with aqueous, biodegradable solvents.

The present invention can be used in a fixed location, or, since the generator and reflector, together with the tube, form a closed system, the invention can be applied in the field as a portable system for tubes that cannot readily be transported to a central facility. If convenient, an array of sound reflectors and matching sound generators, can be set up to treat an array of tubes at the same time.

An important feature of the present invention is the sound generator. The generator is preferably an ultrasonic horn or similar apparatus which is capable of providing sound in the appropriate frequency range (about 20 kHz–100 kHz) and sufficient power output (about 10 watts—5,000 watts, preferably about 10–500 watts).

Another feature of the present invention is the sound reflector. The standing wave pattern set up by the reflector ensures that the ultrasonic energy produced by the generator is distributed uniformly along the length of the tube, resulting in more uniform cleaning of the interior. The reflector is formed of any convenient sound-reflecting material, such as a metal plate. The surface of the reflector may be curved to facilitate setting up a standing wave pattern within the tube by focussing the reflected sound waves.

Still another feature of the present invention is the couplings, which couple the sound reflector and sound generator to their respective ends of the tube. Standard couplings can be used. For example, a coupling may consist of a leak-proof sleeve or jacket with one closed end and one open end, slidable over an end of the tube. The coupling is sealed to the tube to prevent leakage of fluid. Nonstandard couplings may also be used that incorporate an acoustic lens to control the divergence of sound waves A further feature of the present invention is the actuators, which provide for incremental linear positioning of the sound reflector, sound generator, or both. An actuator may be, for example, a linear stepper motor that allows for controlled, incremental movement in 0.001 inch ($2.54\times10^{-3}$ cm) steps over a distance of a few inches.

Another feature of the present invention is the ability via the actuators to adjust the distance d between the sound reflector and the sound generator. When the generator is tuned to the resonant frequency corresponding to this distance, a standing wave pattern is set up along the length of the tube. Cavitation occurs at annuli spaced a distance d/n apart, where sound pressure is minimized and mechanical disruption and agitation of the fluid are maximized. The positions of the annuli are varied by changing the distance between the reflector and generator, thereby changing the resonant frequency and retuning the generator to maintain the standing wave pattern. Thus, the annuli where maximum cavitation occurs—and cleaning efficiency is greatest—are moved along the interior so that all points on the inner surface receive the same amount of cavitation action. At ultrasonic frequencies, variations in d of a few centimeters, corresponding to variations in frequency over a range of a few hundred Hz, suffice to effectively cover the interior of a tube with a length on the order of 10 m. The higher the frequency, the smaller the wavelength of the standing waves and the smaller the distance range needed to cover the entire inner surface. The distance is varied by moving the sound reflector, ultrasonic generator, or both, as may be convenient depending on the particular application.

Other features and advantages of the present invention will be apparent to those skilled in the art from a careful reading of the Detailed Description of a Preferred Embodiment presented below and accompanied by the drawings.

DETAILED DESCRIPTION OF A PREFERRED EMBODIMENT

The inner surface of a fluid-filled elongated tube can be cleaned by the use of ultrasonic standing waves. Energy is transferred to the fluid by setting up a standing wave pattern within the tube, thereby maximizing cavitation effects within the tube and increasing the cleaning effectiveness of the fluid.

Figure 1A:
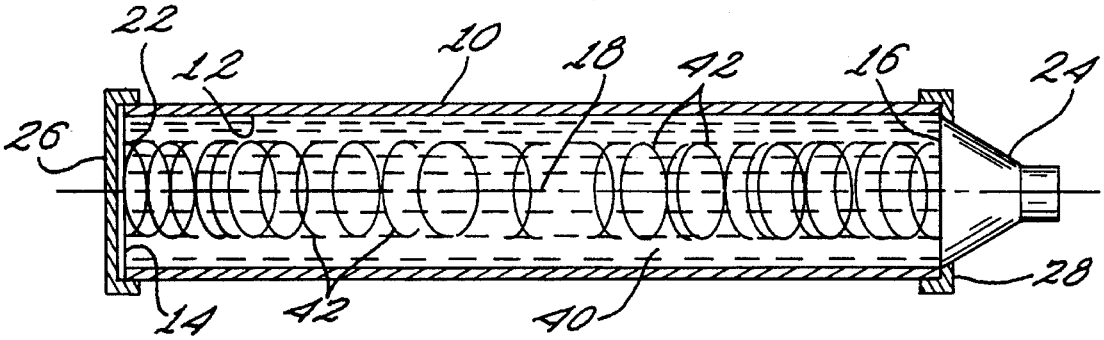
FIG. 1*a* is a cross-sectional view of an apparatus according to a preferred embodiment of the present invention, operated at a nonresonant frequency.

Referring now to FIG. 1*a*, there is shown an apparatus according to a preferred embodiment of the present invention. Elongated tube 10 has inner surface 12, open ends 14, 16, and longitudinal axis 18. The cleaning apparatus of the present invention includes sound reflector 22 and ultrasonic generator 24, coupled to tube 10 by couplings 26 and 28, respectively. Reflector 22 is disposed substantially perpendicularly to axis 18 of tube 10. Coupling 26 seals reflector 22 to end 14, providing a fluid-tight connection to prevent leakage of fluid from tube 10. Similarly, coupling 28 seals generator 24 to end 16 of tube 10. Couplings 26, 28 may be, for example, leakproof sleeves or jackets, incorporating gaskets to prevent leakage of fluid from tube 10.

Tube 10 has one or more resonant frequencies for sound waves propagating longitudinally within the tube, parallel to axis 18. At those frequencies, $$d=nv/f=n\lambda,$$

where n is an integer, d is the distance between reflector 22 and generator 24, v is the velocity of the sound waves in the particular transmitting medium, and f and $\lambda$ their frequency and wavelength, respectively. Thus, tube 10 has resonant frequencies $f_R=nv/d$ and resonant wavelengths $\lambda_R=d/n$.

Tube 10 is filled with fluid 40 by some convenient means. Ultrasonic waves 42, preferably of frequency greater than approximately 20 kHz, are generated inside tube 10 by generator 24. Waves 42 propagate parallel to axis 18 and are reflected by sound reflector 22. Waves 42, shown schematically in FIG. 1*a*, are nonresonant, with frequency $f\neq nv/d$ and wavelength $\lambda\neq d/n$. The incident and reflected waves are out of phase, causing localized cancellation interactions between points of high and low sound pressure. Thus, very little cavitation is induced.

Figure 1B:
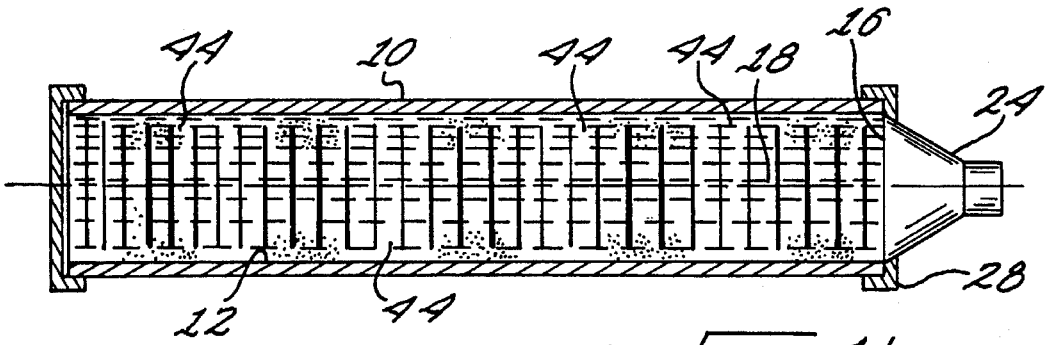
FIG. 1*b* is a cross-sectional view of an apparatus according to a preferred embodiment of the present invention operated at a resonant frequency.

The frequency of sound waves 42 is adjusted until it equals one of the resonant frequencies $f_R$ of tube 10, as illustrated in FIG. 1*b*. At a resonant frequency $f_R$, a standing wave pattern is set up within tube 10, with fixed regions of low and high sound pressure along the length of the tube. Cavitation occurs at annuli 44 spaced a distance d/n apart along interior 12, where sound pressure is lowest and mechanical disruption and agitation of fluid 40 are maximized. Agitation of fluid 40 dislodges foreign material 50, such as grease and metallic dust remaining from machining operations, dirt, and so forth, from inner surface 12. Some heating of fluid 40 may occur due to transfer of sound energy; heat may enhance the cleaning action, depending on the nature of fluid 40 and material 50.

Cavitation also occurs in the absence of sound reflector 22. However, the intensity of the effect decreases with increasing distance from sound generator 24 as the energy of waves 42 is dissipated in fluid 40. Thus, cleaning is non-uniform throughout the length of tube 10. The standing wave pattern set up by use of reflector 22 ensures that the energy produced by generator 24 is distributed relatively uniformly along the length of tube 10, resulting in more uniform cleaning of interior 12.

Cavitation is maximized, and, therefore, cleaning is most effective at annuli 44. The axial positions of annuli 44 must be varied to effectively clean the entire inner surface of tube 10. This can be done by varying the resonant frequency of tube 10, thereby changing the standing wave pattern and the relative positions of annuli 44. The effect is to move the regions of low and high pressure along inner surface 12 so that all interior points receive the same amount of cavitation.

Figure 2:
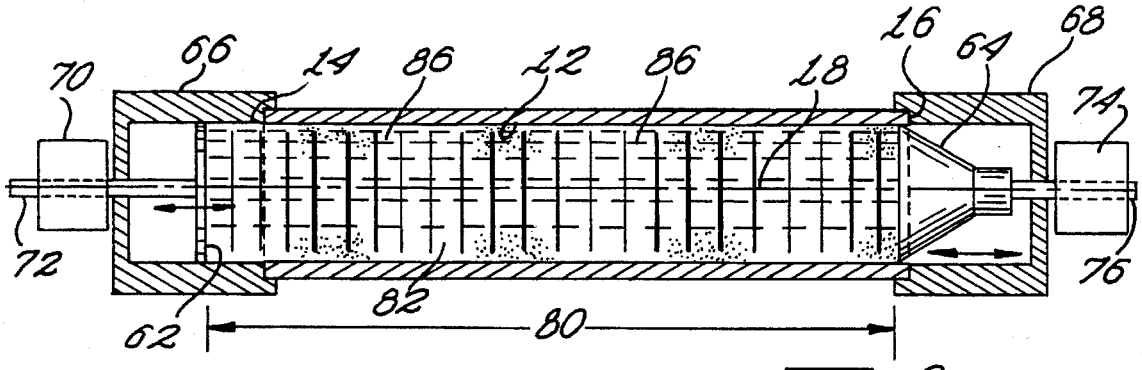
FIG. 2 is a cross-sectional view of an apparatus according to an alternative preferred embodiment of the present invention.

The resonant frequency of an elongated tube can be varied by varying its length. In the case of tube 10, the resonant frequency can be varied by varying the distance between the sound reflector and ultrasonic generator. The present cleaning apparatus, illustrated schematically in FIG. 2, includes sound reflector 62 and ultrasonic generator 64, coupled to ends 14 and 16 of tube 10 by couplings 66 and 68, respectively. Reflector 62 is operatively connected to actuator 70 by connector 72; sound generator 64 is operatively connected to actuator 74 by connector 76. Couplings 66 and 68 seal ends 14 and 16, thereby preventing leakage of fluid 40 from tube 10. Reflector 62 and generator 64 are separated by distance 80 and fluid-filled region 82.

A change in distance 80 changes the resonant frequency of region 82. To maintain a standing wave pattern, generator 64 must be retuned to the new resonant frequency whenever distance 80 is changed. A change to a new resonant frequency moves the locations of the high and low pressure regions within the standing wave pattern. Suppose that $f_{R1}=nv/d_1$ is the resonant frequency for distance $d_1$, and $f_{R2}=nv/d_2$ is the resonant frequency for distance $d_2$. The difference between these two frequencies is given by $$\Delta f=f_{R1}-f_{R2}=nv\{(1/d_1)-(1/d_2)\}, \text{ or}$$

$$\Delta f=nv\Delta d/d_1d_2,$$

where $\Delta d=d_1-d_2$. For small increments in d, $d_1\approx d_2$, so that $$\Delta f\approx nv\Delta d/d^2\approx(f/d)\Delta d.$$

For v=1,000 m/sec, d=10 m, and f=25 kHz, we find that $\lambda$=0.04 m and n=250, so that $\Delta f=2500\ \Delta d$. To clean the entire inner surface 12 of tube 10, the positions of peaks 44 must therefore be varied within a 0.04-m range. The corresponding resonant frequency varies within the range $\Delta f=2500\times 0.04$ m=100 Hz. The higher the frequency, the smaller the wavelength and the smaller $\Delta d$ is needed to cover the entire interior surface.

To clean inner surface 12 of tube 10, sound reflector 62 is connected to end 14 by coupling 66, and sound generator 64 is connected to end 16 by coupling 68. Distance 80 is set to a first value by moving reflector 62 and generator 64 to some fixed positions via actuators 70, 74. The frequency of sound waves 84 is adjusted until it equals the resonant frequency of region 82, whereupon cavitation at annuli 86 dislodges foreign material from surface 12. Cleaning continues for a predetermined time, then distance 80 is changed to a second fixed value by moving reflector 62 or generator 64 to a second fixed position. By changing distance 80, the resonant frequency of region 82 is also changed. The frequency of generator 64 is tuned to this new resonant frequency, with different annuli 86 occurring at different spatial positions along inner surface 12, and cleaning continues at this new frequency. For most effective cleaning, distance 80 is changed several times, so that at various resonant frequencies annuli 86 will occur at essentially every location on surface 12.

Distance 80 is varied by moving sound reflector 62, ultrasonic generator 64, or both, as may be convenient. Whether reflector 62, generator 64, or both are movable will depend on the particular application and configuration of the equipment, as will be readily apparent to those skilled in the art. For example, distance 80 may be set by moving reflector 62 to a fixed position. Sound generator 64 is then programmed to scan over a range of frequencies and lock on the resonant frequency (determined by maximum power transfer) for that distance. After a predetermined time, distance 80 is changed by moving reflector 62 to a new fixed position. Generator 64 locates the new resonant frequency, and cleaning continues. The process is repeated until the desired range of distances has been covered.

Ultrasonic generator 64 is preferably an ultrasonic horn or similar apparatus which is capable of providing the appropriate frequency range (about 20 kHz–100 kHz) and power output (about 10 watts–5,000 watts).

Actuators 70, 74 are devices that provide for incremental positioning of reflector 62 and generator 64, respectively. Actuators 70, 74 may be, for example, a familiar type of linear stepper motor which allows for controlled, incremental movement in 0.001 inches ($2.54\times10^{-3}$ cm) steps over a distance of a few inches.

Reflector 62 is an acoustic mirror formed of any convenient sound-reflecting material, such as a metal plate. While reflector 62 is illustrated as having a flat surface, it may be convenient to curve the surface of reflector 62 to focus the reflected sound waves and thereby facilitate setting up a standing wave pattern within tube 10. The optimum curvature depends on the length of tube 10 and the range of frequencies to be used. Thus, the shape and materials for reflector 62 are determined by the particular application. For applications where tube 10 has one closed end, a separate reflector 62 is not needed, as the inner surface of that end may serve as a sound reflector.

Couplings 66, 68 seal reflector 14 and sound generator 64, respectively, to ends 14, 16 of tube 10. Couplings 66, 68 are such familiar types of coupling as may be convenient. For example, coupling 66 may be a pipe with one closed end, slidable over end 14 and movable over a small distance while maintaining a fluid-tight seal.

Cleaning fluid 40 may be water, or some other, perhaps more aggressive solvent. Since cavitation effects significantly enhance the cleaning ability of fluid 40, the apparatus of the present invention is especially suitable for use with aqueous, biodegradable solvents such as OAKITE NSS, manufactured by Oakite Products, Inc.

Determination of the optimum cleaning parameters (distance and frequency ranges, power levels, operating times) is accomplished on an empirical basis for each application. For example, where a number of similar tubes must be cleaned after completion of machining operations, approximately the same thickness of grease film and the same types of light particulate materials (dust, metal shavings, and so forth) are found on the surfaces of all the tubes. The appropriate operating limits, including time and power levels, are determined for one of the tubes, then implemented for each tube in succession. If desired, the effectiveness of the chosen parameters can be tested by flushing a cleaned tube with a fluid of known composition and then testing the fluid for contaminants. Such testing is performed when setting the parameters for a particular cleaning operation; it is not needed for routine use.

As will be evident, this method can be used to clean tubes having a reasonable range of diameters for any given length. For any length, the diameter—and the wall thickness—must be such that the tube is straight enough to maintain a standing wave pattern in the interior. A too-narrow tube will bend sufficiently that the sound beam cannot be collimated and a standing-wave pattern cannot be set up in the interior. Conversely, the interior surfaces of wide tubes can readily be cleaned by other methods. For stainless steel tubes on the order of 1–10 meters in length, this apparatus can be used to clean the interior surfaces of tubes having diameters ranging from a few centimeters to about 1 meter. The range of tube sizes depends on mechanical properties of the materials as well as the length of the tube, and can best be determined empirically.

The cleaning apparatus of the present invention can be used in a fixed location, or maintained as a portable system for use on tubes that cannot readily be transported to a central facility. A single apparatus can be used to clean tubes of different lengths. If convenient, an array of such apparatus, with a plurality of sound reflectors and a matching plurality of sound generators, can be set up in an array to treat a plurality of tubes at the same time.

It will be apparent to those skilled in the art that many changes and substitutions can be made to the preferred embodiment herein described without departing from the spirit and scope of the present invention as defined by the appended claims.

What is claimed is:

1. A method for cleaning an interior surface of a tube, said tube having a first end and an opposing second end, said method comprising the steps of:

coupling an ultrasonic wave generator to said first end of said tube;

coupling a sound reflector to said second end of said tube, said sound reflector and said ultrasonic wave generator being spaced a distance apart;

filling said tube with a fluid;

generating an ultrasonic standing wave in said fluid using said ultrasonic wave generator and said sound reflector, said standing wave having a number of nodes, said standing wave causing cavitation of said fluid at said nodes; and moving said nodes of said standing wave with respect to said tube by varying said distance between said ultrasonic wave generator and said sound reflector.

2. The method as recited in claim 1, wherein said generating step further comprises the steps of:

generating an ultrasonic wave in said fluid with said ultrasonic wave generator, said ultrasonic wave having a frequency;

reflecting said ultrasonic wave with said reflector; and adjusting said frequency until said ultrasonic wave is a standing wave.

3. The method as recited in claim 1, wherein said fluid is a solvent.

4. The method as recited in claim 1, wherein said moving step further comprises the steps of:

moving said ultrasonic generator with respect to said first end while holding said reflector stationary with respect to said second end; and changing the frequency of said ultrasonic standing wave so that said standing wave is maintained in said tube,

5. The method as recited in claim 1, wherein said moving step further comprises the steps of:

moving said reflector with respect to said second end while holding said ultrasonic generator stationary with respect to said first end; and changing the frequency of said ultrasonic standing wave so that said standing wave is maintained in said tube.

6. The method as recited in claim 1, wherein said moving step further comprises the step of varying said frequency of said standing wave so that the distance between said node changes.

7. The method as recited in claim 1, wherein said frequency of said ultrasonic standing wave is between 20 kHz and 100 kHz.

8. The method as recited in claim 1 wherein said ultrasonic wave generator has a power output and said method further comprises the step of varying said power output of said wave generator.

9. The method as recited in claim 1, wherein said ultrasonic wave generator and said reflector are coupled to said first and said second ends of said tube, respectively with acoustic lenses.

10. A method for cleaning an interior surface of a tube, said tube having a first end and an opposing second end, said method comprising the steps of:

coupling an ultrasonic wave generator to said first end of said tube with a first acoustic lens;

coupling a sound reflector to said second end of said tube with a second acoustic lens, said sound reflector and said ultrasonic wave generator being spaced a distance apart;

filling said tube with a fluid;

generating an ultrasonic wave in said fluid with said ultrasonic wave generator, said ultrasonic wave having a frequency;

reflecting said ultrasonic wave with said reflector;

adjusting said frequency until said ultrasonic wave is a standing wave, said standing wave having a number of nodes, said standing wave causing cavitation of said fluid at said nodes; and moving said nodes of said standing wave with respect to said tube by varying said distance between said ultrasonic wave generator and said sound reflector.

11. The method as recited in claim 10, wherein said fluid is a solvent.

12. The method as recited in claim 10, wherein said moving step further comprises the steps of:

moving said ultrasonic generator with respect to said first end while holding said reflector stationary with respect to said second end; and changing the frequency of said ultrasonic standing wave so that said standing wave is maintained in said tube.

13. The method as recited in claim 10, wherein said moving step further comprises the steps of:

moving said reflector with respect to said second end while holding said ultrasonic generator stationary with respect to said first end; and changing the frequency of said ultrasonic standing wave so that said standing wave is maintained in said tube.

14. The method as recited in claim 10, wherein said moving step further comprises the step of varying said frequency of said standing wave so that the distance between said nodes changes.

15. The method as recited in claim 10, wherein said ultrasonic wave generator has a power output and said method further comprises the step of varying said power output of said wave generator.

16. A method for cleaning an interior surface of a tube, said tube having a first end and an opposing second end, said method comprising the steps of:

coupling an ultrasonic wave generator to said first end of said tube with a first acoustic lens;

coupling a sound reflector to said second end of said tube with a second acoustic lens, said sound reflector and said ultrasonic wave generator being spaced a distance apart;

filling said tube with a solvent;

generating an ultrasonic wave in said solvent with said ultrasonic wave generator, said ultrasonic wave having a frequency;

reflecting said ultrasonic wave with said reflector;

adjusting said frequency until said ultrasonic wave is a standing wave, said standing wave having a number of nodes, said standing wave causing cavitation of said solvent at said nodes;

moving said nodes of said standing wave with respect to said tube by varying said distance between said ultrasonic wave generator and said sound reflector; and varying said power output of said wave generator.

17. The method as recited in claim 16, wherein said moving step further comprises the steps of:

moving said ultrasonic generator with respect to said first end while holding said reflector stationary with respect to said second end; and changing the frequency of said ultrasonic standing wave so that said standing wave is maintained in said tube.

18. The method as recited in claim 16, wherein said moving step further comprises the steps of:

moving said reflector with respect to said second end while holding said ultrasonic generator stationary with respect to said first end; and changing the frequency of said ultrasonic standing wave so that said standing wave is maintained in said tube.

19. The method as recited in claim 16, wherein said moving step further comprises the step of varying said frequency of said standing wave so that the distance between said nodes changes.

* * * * *